US007670176B2

(12) United States Patent
Lemke et al.

(10) Patent No.: US 7,670,176 B2
(45) Date of Patent: Mar. 2, 2010

(54) DUAL CONNECTOR FOR AN ANTENNA ELEMENT

(75) Inventors: Donald V. Lemke, Naperville, IL (US); Yefim Torban, Cheshire, CT (US)

(73) Assignee: Palco Connector Incorporated, Naugatuck, CT (US)

( * ) Notice: Subject to any disclaimer, the term of this patent is extended or adjusted under 35 U.S.C. 154(b) by 0 days.

(21) Appl. No.: 12/265,892

(22) Filed: Nov. 6, 2008

(65) Prior Publication Data

US 2009/0061685 A1 Mar. 5, 2009

(51) Int. Cl.
*H01R 9/05* (2006.01)

(52) U.S. Cl. ..... 439/581

(58) Field of Classification Search ..... 439/578, 439/581, 582, 583

See application file for complete search history.

(56) References Cited

U.S. PATENT DOCUMENTS

| | | | | |
|---|---|---|---|---|
| 4,444,453 | A | 4/1984 | Kirby et al. | |
| 4,917,630 | A | 4/1990 | Hubbard | |
| 4,966,560 | A | 10/1990 | Marzouk | |
| 5,516,303 | A | 5/1996 | Yohn et al. | |
| 5,595,502 | A * | 1/1997 | Allison | 439/429 |
| 5,676,565 | A | 10/1997 | Vagnoni | |
| 5,785,554 | A | 7/1998 | Ohshiro | |
| 5,882,233 | A | 3/1999 | Idehara | |
| 5,967,852 | A | 10/1999 | Follingstad et al. | |
| 6,769,933 | B2 | 8/2004 | Bence et al. | |
| 6,773,303 | B1 | 8/2004 | Lin | |
| 6,805,583 | B2 | 10/2004 | Holliday et al. | |
| 6,863,565 | B1 * | 3/2005 | Kogan et al. | 439/580 |
| 7,029,327 | B2 * | 4/2006 | Devine | 439/587 |
| 2002/0090860 | A1 | 7/2002 | Bohmer et al. | |
| 2004/0038587 | A1 * | 2/2004 | Yeung et al. | 439/581 |

FOREIGN PATENT DOCUMENTS

| | | | |
|---|---|---|---|
| GB | 2057781 | A | 4/1981 |
| WO | 8903600 | A | 4/1989 |

* cited by examiner

*Primary Examiner*—Ross N Gushi
(74) *Attorney, Agent, or Firm*—DeLio & Peterson, LLC; Robert Curcio

(57) ABSTRACT

Two connection interfaces are combined in a single assembly for high frequency signal propagation of a GPS antenna. At least one connection interface is a constant impedance connector. The connector assembly allows for the application of o-rings and gaskets to be placed circumferentially about the radome to protect against environmental elements, mechanical shock and vibration. The first connection interface has a male plug on a first piece of a dual connector design, and a complementary female plug on a second piece. The second connection interface comprises a plug of any standard industry connector mounted on the second piece opposite the complementary female plug, and is configured to easily mate to a corresponding plug from a cable or other electronic equipment.

3 Claims, 2 Drawing Sheets

DUAL CONNECTOR FOR AN ANTENNA ELEMENT

BACKGROUND OF THE INVENTION

1. Field of the Invention

This invention relates to antennas, specifically to a connection scheme for antenna elements, such as a global positioning satellite antenna, and more particularly to a dual connector assembly combining two connector types in a single package for an antenna, with a first connector having an inner conductor support and capable of providing a constant impedance connection for the signal path, including when the mating portions of the first connector are only partially engaged, and a second connector which provides for a common connection to a cable or directly to electronic equipment.

2. Description of Related Art

Connectors link the various conductors of electronic components and transmission lines to equipment or other cables. Typically, antenna components are fabricated with wire connections, and do not include their own connectors. In order to mate a high frequency application antenna to other electrical equipment, such as a receiver or transmitter, it is necessary to combine the antenna with a desired connector interface. The connector will generally be of a type that is compatible with either the mating equipment connector or a mating cable connector. For high frequency and/or field serviceable and/or configurable applications a coaxial connection is preferred. For example, a GeoHelix® GPS antenna made by Sarantel of Wellingborough, England, is available with two exposed wires for connection. It is not uncommon for antennas to terminate with wires, so that the designer may choose the appropriate connection scheme that works best for the application.

Generally, it is desirable to attach a coaxial compatible connector to an antenna device such as the GeoHelix® GPS antenna in the form of a BNC-type connector, TNC-type connector, subminiature version A (SMA) type connector, N-type connector, or the like. However, the attachment to these connectors alone does not relieve the connected design from impedance mismatches, mechanical stress, vibration, or shock.

A coaxial connector provides an electrical conductive contact between conductors of electricity having an inner conductor and an outer conductor, which is generally separated by a dielectric spacer. The connection is typically of a type that may be readily connected and disconnected, repeatedly by attachment and detachment of contact supporting structure on each conductor. The connectors usually include a small projecting male center conductor and a corresponding female center conductor made to mechanically and electrically receive the male portion. However, the center conductor portion of the connector is quite fragile and prone to damage. The center conductor portion can become damaged when, for example, the connector is misaligned during a connection. This is likely to happen during "blind-mate" connections, remotely located connections, and quick connect/disconnect applications. Generally, the center conductor is made of a bendable copper wire of finite diameter, having little or no mechanical support to resist bending or other forces. In typical coaxial connectors, the male portion of the center conductor projects and extends out beyond the outer conductor for insertion into the female portion. Thus, the center conductor tip of a coaxial cable connector is exposed and vulnerable to handling and deforming during insertion.

One difficulty with directly mounting connectors to antenna assemblies is that conventional connectors are rigid, which may result in alignment difficulties and undesirable stresses on the antenna components and circuitry. Mounting tolerances can add up to the point where proper connection is not possible, or an undesirable built-in stress applied to solder joints or the brittle antenna element results. Even if the connectors can be mounted accurately to their respective antenna assemblies, it can be difficult to get the connectors to mate. Conventional single piece coaxial connectors that are rigidly soldered are not well suited to this type of application. The problem is compounded where the connectors are positioned in a manner where they cannot be seen and must be mated blind.

In the case of sensitive, high frequency electronic components, such as brittle, fragile ceramic antennas, the connector design must also promote mechanical shock and vibration protection, and anticipate thermal expansion and contraction conditions that can stress the electronic device and soldered connections to the device. Importantly, the connector must also exhibit an impedance match with the antenna. Otherwise, signal disruption and reflections will degrade the signal quality and amplitude due to the impedance mismatch. This is especially true in the higher frequency regimes, in applications where the signal frequency is on the order of 1 giga Hertz and higher, such as global positioning satellite communications.

Although the prior art has attempted in numerous ways to minimize the impedance mismatches that normally occur in connectors, there is no teaching or suggestion to strengthen the bendable center conductor or provide any form of structural support to the center conductor while keeping the impedance constant throughout the connector engagement. Additionally, the prior art has not considered a packaged connector design capable of relieving the impedance mismatches and attenuating mechanical shock and vibration effects on sensitive electronic devices such as global positioning satellite antennas, while simultaneously providing an industry common connector for attachment to cabling and other circuitry.

SUMMARY OF THE INVENTION

Bearing in mind the problems and deficiencies of the prior art, it is therefore an object of the present invention to provide a connector assembly for a GPS antenna that includes a constant impedance connector for maintaining the constant impedance when the connector is partially or fully engaged while employing a support structure on the center conductor.

It is another object of the present invention to provide a connector for a GPS antenna that attenuates mechanical shock and vibration.

A further object of the invention is to provide a connector design for an antenna capable of providing for environmental stresses, mechanical stresses, and impedance mismatches in a single package.

Still other objects and advantages of the invention will in part be obvious and will in part be apparent from the specification.

The above and other objects, which will be apparent to those skilled in the art, are achieved in the present invention, which is directed to a dual connector assembly for high frequency applications comprising: a connector body; a constant impedance connector comprising a first plug and a female receptacle; a second connector housed in the connector body; the constant impedance connector having the first plug with an inner and outer conductor and the female receptacle with an inner and outer conductor, wherein the first plug and corresponding female receptacle form an overlap region when the first connector mating portions are electrically connected and at least partially engaged, the constant impedance connector first plug in electrical communication with electronic or passive electromagnetic components, the constant impedance connector female receptacle housed in the connector body; the second connector rigidly connected to, and in electrical communication with, the female receptacle of the constant impedance connector through the connector body; and at least one compressible, resilient member in contact with the connector body for attenuating shock and vibration forces on the electronic or passive electromagnetic components. The second connector may be a TNC-type, BNC-type, N-type, or SMA-type connection. The passive electromagnetic component may include an antenna, such as a GPS antenna. The electronic component may include circuitry for GPS, cell phone, satellite phone, or broadcast satellite reception applications.

The dual connector assembly may also include a cover encompassing the electronic or passive electromagnetic component, the cover forming a peripheral seal with at least one compressible, resilient member when the cover is attached to the connector body. At least a second compressible, resilient member located between the cover and the electronic or passive electromagnetic component may also be used.

The dual connector assembly may further include: an upper connector casing having a threaded interior surface for attaching to the connector body at one end, and having a flange at the other end for grasping and securing a cover to the connector body; a lower connector casing having an interior surface for attaching to the connector body and the second connector, the lower connector casing having a shaped member for connecting the dual connector assembly to a complementary mating connection for the second connector; wherein the dual connector assembly comprises a semi-rigid construction when the upper and lower connector casings are threadedly secured to the connector body.

In a second aspect, the present invention is directed to a dual connector assembly comprising: a first connector having a plug and a female receptacle, wherein the plug is a complementary mating piece for the female receptacle, the plug in electrical communication with an electronic or passive electromagnetic component, the female receptacle in electrical communication with the plug and housed in a first end of a connector body; a second connector having a first plug housed in a second end of the connector body, the second connector first plug in electrical communication with the first connector female receptacle, a cover surrounding the electronic or passive electromagnetic component; at least one resilient, compressible member located between the connector body first end and the electronic or passive electromagnetic component; an upper connector casing having a threaded interior surface for attaching to the connector body at one end, and having a flange at an other end for grasping the cover to secure the cover to the connector body; a lower connector casing having an interior surface for attaching to the connector body and the second connector first plug, the lower connector casing having a shaped member for connecting the dual connector assembly to a complementary mating female receptacle for the second connector first plug; wherein the first connector forms a constant impedance connection even when the first connector plug and female receptacle are partially engaged, and wherein the dual connector assembly comprises a semi-rigid construction when the upper and lower connector casings are threadedly secured to the connector body.

The first connector plug and female receptacle form a constant impedance connector including: the plug comprising an inner conductor with an outer diameter and a free end, an outer conductor with an inner diameter and a free end, the inner conductor coaxial with the outer conductor, the inner conductor free end projecting beyond the outer conductor free end; the first connector female receptacle housed within the connector body, including inner and outer conductors complementary to the first connector plug, a dielectric spacer between the inner and outer conductors, and extending up to the outer conductor free end; an electrically conductive cap substantially covering the inner conductor free end projected beyond the outer conductor free end, the cap coaxial with the inner conductor, substantially cylindrical, and having an inner diameter substantially equal to the inner conductor outer diameter, and having an outer diameter slightly larger than the inner conductor outer diameter; the dual connector assembly the first connector plug and female receptacle are shaped, and material for the dielectric spacers is chosen, such that when the first connector plug and female receptacle are engaged along a central axis of the engaged connection, the effective outer diameter of the inner conductor referenced by "d", the effective inner diameter of the outer conductor referenced by "D", and a relative dielectric constant of the medium therebetween referenced by epsilon, satisfy the equation:

$$Z=138(\in)^{-1/2}\log(D/d), \qquad 1$$

where "Z" is a characteristic impedance, and the characteristic impedance is substantially constant throughout the central axis of an engaged or partially engaged connection.

The dual connector assembly further includes at least a second resilient, compressible member located between the cover and the electronic or passive electromagnetic component.

The free end of the projecting conductor of the first connector plug with the cap is adapted to overlap with the free end of the projecting conductor of the first connector female receptacle, forming an overlap region when the first connector plug and female receptacle are electrically connected and at least partially engaged.

The first connector plug and female receptacle may engage and connect to form a continuous signal pathway through the dual connector assembly, the first connector plug and female receptacle, and the overlap region, whereby the characteristic impedance "Z" remains substantially constant within the overlap region, having the overlap region form part of a signal pathway.

In a third aspect, the present invention is directed to dual connector assembly comprising: a first connection interface including a constant impedance, PKZ connection having a first plug connected to an electronic or passive electromagnetic component, and a complementary female receptacle for mating with the first plug, the female receptacle housed in a shaped aperture of a connector body top end; a second connector; a cover encompassing the electronic or passive electromagnetic component; the connector body including: a threaded outer surface for attachment to an upper casing, and a shaped aperture for housing a female receptacle of the second connector in the connector body bottom end; the upper casing having threads for attachment to the connector body, and having a flange on one end to grasp and secure the cover to the connector body; a first resilient, compressible member located between the cover base and the connector body top end, forming a peripheral seal with the connector body when the upper casing is secured to the connector body; and a second resilient, compressible member located between the cover interior and the electronic or passive electromagnetic component for attenuating shock and vibration effects.

The PKZ connector includes: inner and outer conductors of the first connection interface first plug and female receptacle, the first connection interface first plug and female receptacle having a predetermined shape such that when the first plug of the first connection interface is engaged with the female receptacle of the first connection, along a central axis of the engaged connection, the effective outer diameter of the inner conductor referenced by "d", the effective inner diameter of the outer conductor referenced by "D", and the dielectric constant of the medium therebetween referenced by ∈, satisfy the equation:

$$Z=138(\in)^{-1/2}\log(D/d), \quad 1$$

where "Z" is the characteristic impedance, and the characteristic impedance is substantially constant throughout the central axis of the engaged connection.

BRIEF DESCRIPTION OF THE DRAWINGS

The features of the invention believed to be novel and the elements characteristic of the invention are set forth with particularity in the appended claims. The figures are for illustration purposes only and are not drawn to scale. The invention itself, however, both as to organization and method of operation, may best be understood by reference to the detailed description which follows taken in conjunction with the accompanying drawings in which:

DESCRIPTION OF THE PREFERRED EMBODIMENT(S)

In describing the preferred embodiment of the present invention, reference will be made herein to FIGS. 1 & 2 of the drawings in which like numerals refer to like features of the invention.

In accordance with the present invention, a dual connector assembly is provided for a GPS antenna or other types of sensitive, high frequency electronics and passive electromagnetic components. The combination of each connector of the dual connector assembly provides for a constant impedance connection, shock and vibration isolation, and an industry accepted connection to associated cabling and/or equipment.

Figure 1:
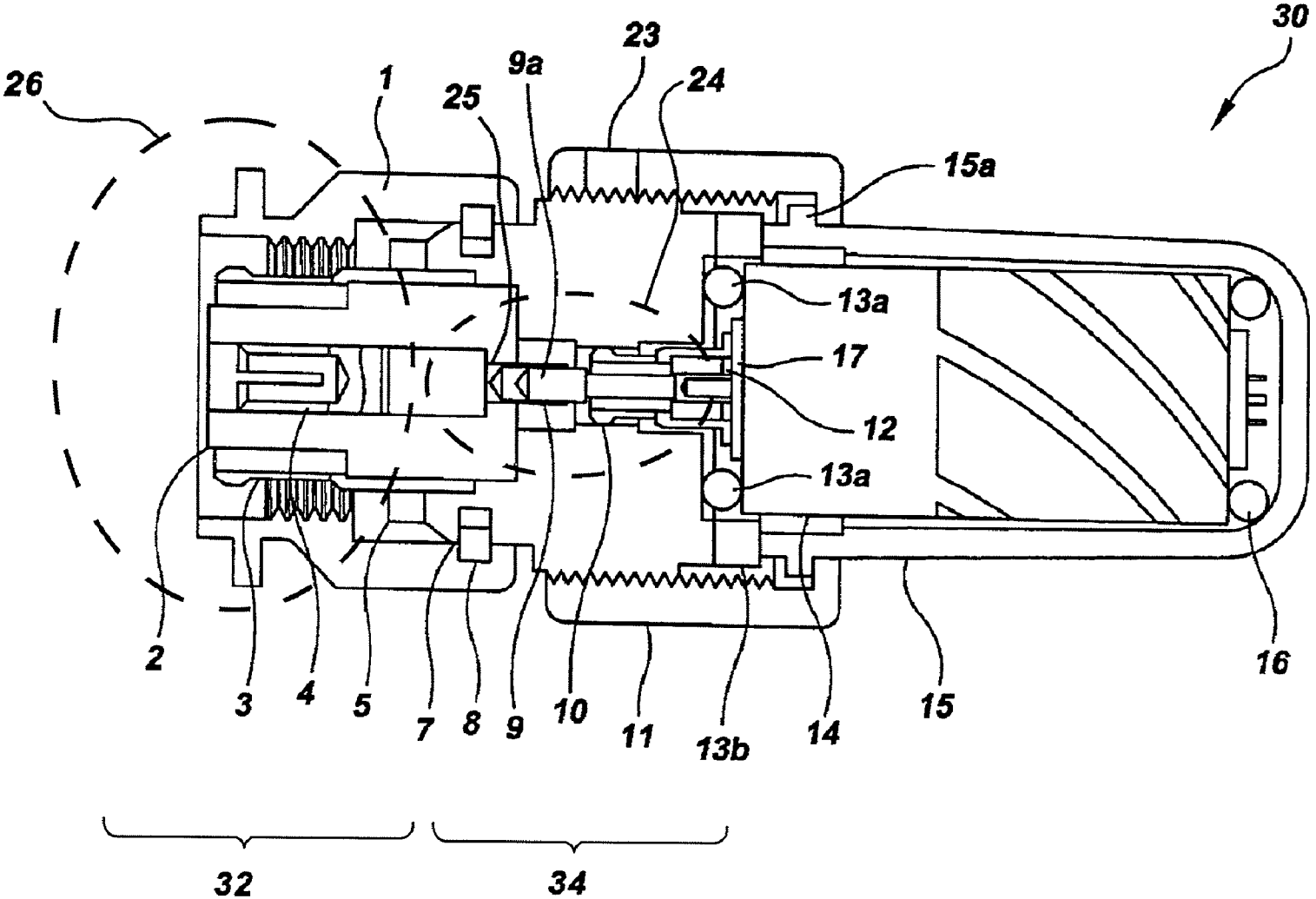
FIG. 1 is a cross-sectional view of the dual connector of the present invention.

FIG. 1 depicts a dual connector assembly 30 of the present invention. Shown for illustrative purposes is a GPS antenna assembly 14 with radome cap 15. Antenna structures other than GPS antennas may be mounted using the dual connector assembly of the present invention, and the present invention is not limited solely to GPS antennas. Furthermore, the present invention may be used for other sensitive electronics that do not include antennas, but require constant impedance matching during varying partial engagement, and mechanical stress and shock protection, in a single, quick attach and release mechanism.

Typically, antenna assemblies have signal wires protruding from the antenna structure for connection to electronics. They commonly are not equipped with connectors, leaving the connection specifics for the user to determine. The antenna's protruding wires are generally soldered (hard-wired) to a connector plug for insertion and removal from a receiving, mating connector plug. The present invention introduces a dual connector assembly where one connector comprises male and female parts, and is designed to accommodate impedance matching, even when the portion of the connector attached to the antenna is only partially engaged, while the package, and both connectors therein, simultaneously assist in isolating the antenna structure from vibration and shock. The second connector is preferably a more common connector in the industry for mating to coaxial connections that ultimately transmit the received signals to electronics.

Referring to FIG. 1, antenna assembly 14 is attached to a dual connector assembly having a first piece 32 and a second piece 34 that form two separate connection interfaces 24, 26. The first connection interface 24 is formed at the junction of the first piece 32 and the second piece 34, and includes a male plug 12 on the first piece and a female receptacle 25 on the second piece. The male plug 12 having an inner conductor support that is attached to antenna assembly 14. The male plug 12 of the first piece 32 in combination with the corresponding female receptacle 25 of the second piece 34 forms the first connection interface 24 of the dual connector assembly, which is capable of providing a constant impedance connection for the signal path, including when the mating portions are not fully engaged. Preferably, this first connector may be as described in U.S. Pat. No. 6,863,565 issued to Kogan, et al., entitled, "CONSTANT IMPEDANCE BULLET CONNECTOR FOR A SEMI-RIGID COAXIAL CABLE." This type of connector has also been referred to as a PKZ connector. Other connector designs that promote constant impedance connections at high frequencies may be employed as well, and the present invention is not limited to having the constant impedance connector designed by Kogan, et al., as the first connector in the dual connector scheme. Importantly, for the constant impedance design, the center conductor of the first male connector plug 12 is supported for enhanced structural integrity. Although a male plug 12 of first piece 32 is used to attach to the antenna, the order of male/female connection of the first connection interface 24 may be interchangeable. For illustrative purposes only, the antenna wires are shown attached to, and terminated by, the male plug 12. Thus, the male plug 12 of first piece 32 is hard-wired to the electrical wires protruding from the antenna assembly. The male plug has an inner conductor 9 that projects beyond its outer conductor contact 10. The male plug 12 and female receptacle 25 form the first connector at the first connection interface 24.

If the constant impedance connector design of Kogan, et al., or a similar connector is used as the first connector for first connection interface 24, an electrically conductive cap 9*a* or bullet may be used to substantially cover the inner conductor free end and project beyond the outer contact 10 conductor free end. The cap 9*a* is coaxial with the inner conductor, substantially cylindrical, and has an inner diameter substantially equal to the inner conductor outer diameter, with an outer diameter slightly larger than the inner conductor outer diameter. The outer diameter of the cap or bullet is substantially constant throughout the cap's length. The cap provides structural integrity to the center conductor, and electrical contact to the adjoining female receptacle inner conductor. The cap's constant diameter facilitates a constant impedance load for the signal throughout the connector. The male plug 12 of first piece 32 forming a mating portion of first connection interface 24 of the constant impedance connector is shown attached to the GPS antenna at disc 17.

The second piece 34 of the dual connector assembly has two ends, a first end and a second end, for making electrical connections. A first end comprises the mating female receptacle 25 to the male plug 12 of the first piece 32. The second end is opposite the first end, and forms one mating part of a coaxial connector. The end on the second piece 34, female receptacle 25, mates with male plug 12 on first piece 32, and completes first connection interface 24. The second end on second piece 34 is one part of a coaxial connector that is made to mate with a corresponding coaxial connector part (not shown) and form a second connection interface 26. The first end of second piece 34, female receptacle 25, which is part of the first connection interface 24, is formed in body 7. The mating female receptacle 25 has an outer conductor that projects beyond the inner conductor, and is made to receive male plug 12. Each mating portion forming first connection interface 24 is provided with an inner conductor, an outer conductor, and a dielectric spacer therebetween. An upper connector casing or clamp nut 11 having threads for securing itself to body 7 tightly secures first piece 32 to second piece 34. The threads are located on the periphery of clamp nut 11 and on body 7 for mounting. Clamp nut 11 circumferentially contacts flange 15*a* of radome 15. When clamp nut 11 is threaded onto body 7 it secures antenna assembly 14. An epoxy fill 23 may be used within an aperture of clamp nut 11 to bond clamp nut 11 with body 7 and lock any undesired clamp nut rotation once the clamp nut is secured to the body. Rubberized gaskets and o-rings are used to attenuate mechanical stress and shock vibrations. A resilient, compressible member 13*a*, such as an O-ring, is located at the bottom of antenna assembly 14, between the assembly and body 7. The tightening of clamp nut 11 provides a preloading compression to the resilient member 13*a*, forming a circumferential seal about the assembly's bottom, isolating environmental elements from the electric circuitry and providing a cushion for attenuating vibrations. Similarly, gasket 13*b*, located about the bottom periphery of radome 15, seals the interface between the bottom edge of radome 15 and body 7, providing further shock and vibration attenuation, as well as providing for an environmental seal. Another resilient, compressible member 16, which also may be an o-ring, located at the top of antenna assembly 14, is tightly secured between the antenna assembly and the inside top of radome 15. Mechanical movements, stresses, and vibrations from radome 15 to antenna assembly 14 are reduced by the circumferential contact of resilient member 16.

Male plug 12 of first piece 32, which forms first connection interface 24 with corresponding female receptacle 25 of second piece 34, has contacts 9, 10 and is configured to connect with corresponding female receptacle 25 having corresponding inner and outer conductors and a corresponding dielectric spacer. Together, male plug 12 of first piece 32 and female receptacle 25 of second piece 34 make up the constant impedance connector of first connection interface 24. Body 7 allows for an electrical connection of the inner and outer conductors of male plug 12 to the corresponding female receptacle 25. The outer contact 10 of the male plug 12 is electrically connected to the outer conductor 3 of second piece 34. The coaxial cable connector end portion of second piece 34, which forms second connection interface 26 with a corresponding coaxial mating connector (not shown) is fixably attached to coupling nut 1 by retaining ring 8. This attachment allows for the coaxial cable connector end portion, which is secured by lower connector casing or coupling nut 1, to be fixably attached to second piece 34. Body 7 forms electrical connection from outer contact 10 of the first piece to outer contact 3 of the second piece. Upon attachment, body 7 also protects the electrical connections from external forces and environmental elements. Contacts 3, 4 represent the inner and outer electrical contacts of the coaxial connector end portion in this dual connection interface scheme. The coaxial connector end portion may be of the form found in standard connector designs, such as BNC-type, TNC-type, N-type, SMA-type connectors, and the like. Any industry accepted coaxial connector may be employed. Preferably the coaxial connector end portion is represented by a female receptacle, as shown in FIG. 1; however, the coaxial connector end portion could easily be configured for a male plug, and the selection of which plug type to use, male or female, is arbitrary. A male center connection is more easily damaged, thus there is a preference for using a female center connection on a field repairable antenna unit.

In order to achieve a constant impedance connector, the inner and outer conductors of male plug 12 of the first piece 32 and the corresponding female receptacle 25 of the second piece 34 are of predetermined shape, such that when male plug 12 is engaged with the female receptacle 25, along the central axis of the engaged connection, the effective outer diameter of the inner conductor referenced by "d", the effective inner diameter of the outer conductor referenced by "D", and the dielectric constant of the medium therebetween referenced by $\in$, satisfy the equation:

$$Z=138(\in)^{-1/2}\log(D/d), \qquad 1$$

where "Z" is the characteristic impedance. The geometry is determined and the dielectric material selected so that anywhere along the central axis of the first connector the impedance is substantially constant. The mating female receptacle 25 of second piece 34 must have an inner conductor with inner diameter large enough to encompass the outer diameter of male plug 12. Female receptacle 25 must also have an outer conductor diameter and corresponding dielectric portion that maintains the impedance equality as it engages the inner conductor of male plug 12.

The male plug's inner contact 9 preferably includes a cap 9*a*. Cap 9*a* alters the geometry of the connection interface so that constant impedance is ensured throughout the connector. Female receptacle 25 must have an inner conductor with inner diameter large enough to encompass the male plug's cap outer diameter. Female receptacle 25 must also have an outer conductor diameter and corresponding dielectric portion that maintains the impedance equality as it engages the bullet cap on the inner conductor of male plug 12.

As shown in FIG. 1, insulator 2 encompasses female receptacle 25 of second piece 34 at one end and a female receptacle of the coaxial connector end portion at the other end of second piece 34. The latter forming the female receptacle portion of second connection interface 26. The female receptacle of the coaxial connector end portion has an inner conductor 4 that is centered coaxially with respect to the outer conductor 3. Resilient member 5 provides environmental isolation for the second connector plug.

The outer conductor or contact 10 of male plug 12 of first piece 32 preferably comprises spring finger contacts, which are capable of providing a pressure contact to conduct electrical signals to body 7. Body 7, in turn, is electrically connected to outer contact 3 of the second piece. Thus, the outer contacts of each piece are in electrical contact with one another. When clamp nut 11 is tightened on body 7, male plug 12 is inserted within the center aperture of body 7 and connects with the corresponding female receptacle 25 of second piece 32. Similarly, the inner conductors the connectors are in electrical contact for signal transmission.

In summary, the dual connector assembly has a first piece 32 and a second piece 34. The two pieces are joined at first connection interface 24. A male plug 12 of first piece 32 connects with a complementary female receptacle 25 of second piece 34 to form first connection interface 24. Male plug 12 is in electrical communication with an electronic or passive electromagnetic component of first piece 32, and the complementary female receptacle 25 of second piece 34 is in electrical communication with male plug 12. A coaxial connector end portion is formed on second piece 34 opposite the complementary female receptacle 25. The coaxial connector end portion is in electrical communication with the complementary female receptacle 25, connecting each inner conductor to one another, and each outer conductor to one another.

A protective cover surrounds the electronic or passive electromagnetic component, and at least one resilient, compressible member is located between the connector body first end and the electronic or passive electromagnetic component.

An upper connector casing is used to secure the cover to the connector body. A threaded interior surface of the upper connector casing threadably attaches the upper casing to the connector body at one end. The upper connector casing has a lip at the open, unthreaded end to mount over a flange on the cover. In this manner, the upper connector casing, or clamp nut, grasps the cover and secures it to the connector body.

A lower connector casing is used to secure the coaxial connector end portion to the connector body of the second piece. The lower connector casing has an interior surface for attaching to the connector body and the coaxial connector end portion. The lower connector casing may also have a shaped member for connecting the dual connector assembly to a complementary mating plug for coaxial connector end portion (not shown).

Importantly, the first connection interface 24 forms a constant impedance connection even when the associated male and female receptacle is only partially engaged. The dual connector assembly comprises a semi-rigid construction when the upper and lower connector casings are threadedly secured to the connector body.

Preferably, male plug 12 of first piece 32 has an inner conductor with an outer diameter and a free end and an outer conductor with an inner diameter and a free end. The inner conductor is coaxial with the outer conductor. The inner conductor free end projects beyond the outer conductor free end. The complementary female receptacle 25 is housed within the connector body of second piece 34, including having the inner and outer conductors complementary to male plug 12 of first piece 32, a dielectric spacer 2 between inner and outer conductors, and extending up to the outer conductor free end. An electrically conductive cap substantially covers the inner conductor free end projected beyond the outer conductor free end. The cap is coaxial with the inner conductor, substantially cylindrical, has an inner diameter substantially equal to the inner conductor outer diameter, and has an outer diameter slightly larger than the inner conductor outer diameter. The dual connector assembly's male and female receptacle of first connection interface 24 are shaped, and material for the dielectric spacers is chosen, such that when the male and female receptacle are engaged along a central axis of the engaged connection, the characteristic impedance is substantially constant throughout said central axis of an engaged or partially engaged connection.

In one embodiment, the present invention combines two pieces and forms two connection interfaces 24, 26 in a single assembly for high frequency signal propagation. At least one connection interface (24) forms a constant impedance connector, which is preferably a PKZ connector or other similar design. On first piece 32, the assembly allows for the application of o-rings and gaskets to be placed circumferentially about a radome to protect against environmental elements, mechanical shock and vibration. Second piece 34 has a body for threaded attachment of a clamp nut, which secures the radome to the first piece by clamping down on a flange portion of the radome. First piece 32 has male plug 12 connected on one end to an antenna, and connecting on the other end to a corresponding female receptacle 25 on second piece 34. Second piece 34 has a female receptacle of any standard industry connector plug on the end opposite the complementary female receptacle 25 of first connection interface 24, and is configured to easily mate to a corresponding male plug from a cable or other electronic equipment, forming second connection interface 26.

Figure 2:
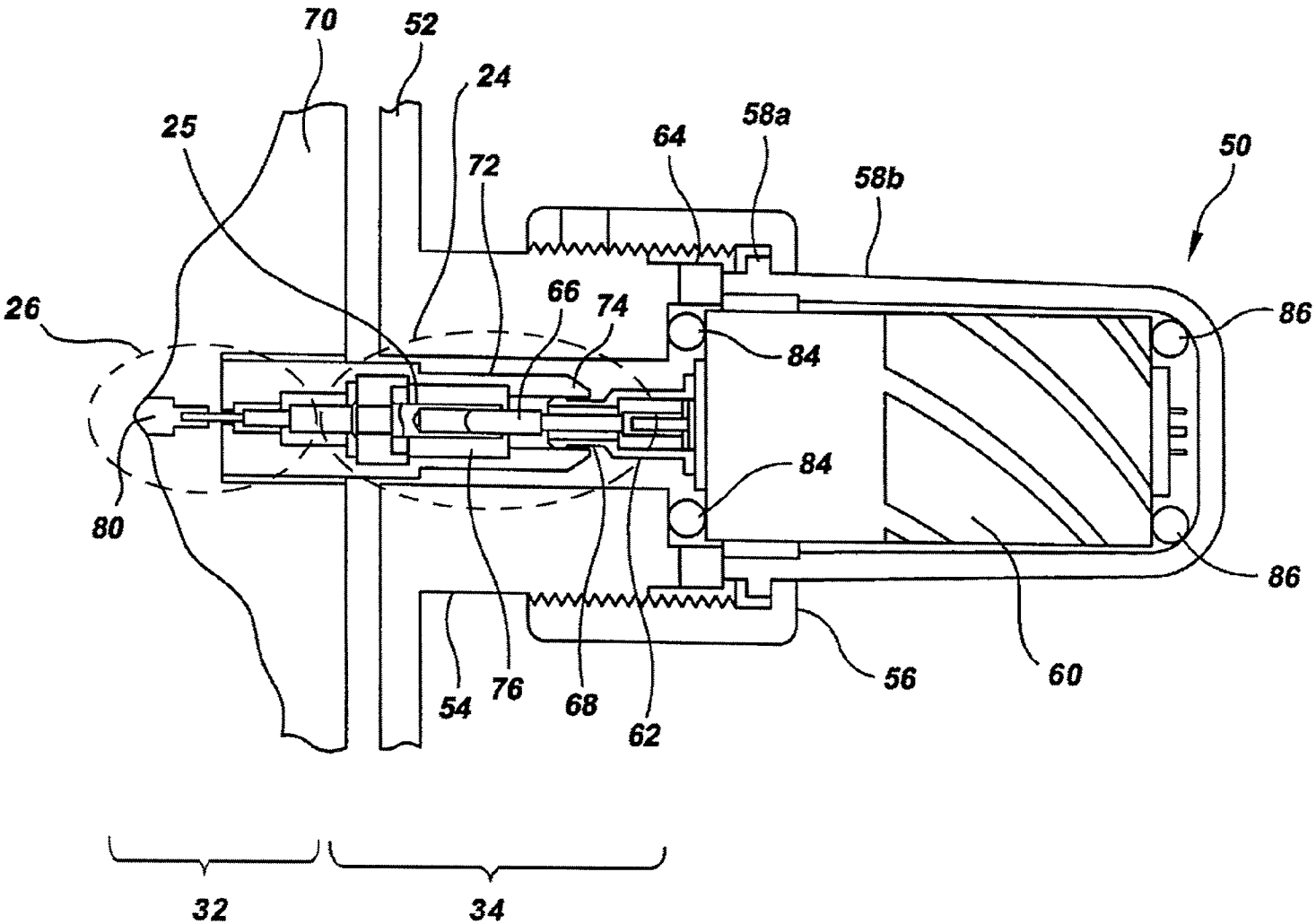
FIG. 2 is a cross-sectional view of the dual connector of the present invention terminating to a microstrip on a printed circuit board.

FIG. 2 depicts a second embodiment 50 of the present invention. This embodiment attaches a GPS antenna to the housing of a GPS receiver 52. Housing 52 has a connector jack 54 with a threaded outer periphery for a screw attachment to the radome nut 56. The radome nut 56 is shown clamping a wing portion 58*a* of radome housing 58*b*; however, radome nut 56 may also be integral with radome housing 58*b*. Antenna element 60 is protected within radome housing 58*b*, and mounts to a PKZ jack 62 in a similar fashion as in the first embodiment. The radome terminates at the connector jack 54, secured by radome nut 56, which tightens and compresses gasket 64 between jack 54 and radome 58*a*.

In this second embodiment, a first connector plug of the PKZ jack 62 is securably fixed to antenna element 60. Generally, this first connector is the male portion of PKZ jack 62, although it need not be limited solely to a male portion, and the dual connector design may be reconfigured with the first connector being a female receptacle. Inner conductor 66 and outer conductor 68 form the male connection of PKZ jack 62. The mating receptacle 72 includes outer conductor tube 74 for contact with outer conductor 68, and an inner conductor sleeve 76 that peripherally contacts the bullet inner conductor 66. Outer conductor tube 74 forms an electrical connection to the housing or to a ground or return signal located on PCB 70. Inner conductor 76 terminates on a microstrip 80 or other planar-transmission line segment on PCB 70. In this manner, antenna element 60 may be in electrical communication with supporting circuitry on PCB 70 through a constant impedance PKZ connector 62 and mating second connector 72. Resilient gaskets 84, 86 attenuate shock and vibration forces through compressions at the connector jack 54 and within the internal top portion of radome 58, respectively.

While the present invention has been particularly described, in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

Thus, having described the invention, what is claimed is:

1. A connector assembly for high frequency applications comprising:

a connector body;

a first connection interface including forming a constant impedance connector comprising a first plug and a female receptacle;

a second connector housed in said connector body, said second connector having a first plug for mating with said constant impedance connector, said second connector first plug having an inner conductor terminating at one end with a microstrip or planar-transmission line conductor, such that said second connector first plug and said microstrip or planar-transmission line conductor forming a second connection interface;

said constant impedance connector having said first plug with an inner and outer conductor and said female receptacle with an inner and outer conductor, wherein said first plug and said female receptacle form an overlap region when said first plug and said female receptacle are electrically connected and at least partially engaged, said constant impedance connector first plug in electrical communication with electronic or passive electromagnetic components, said constant impedance connector female receptacle housed in said connector body.

2. The connector of claim 1 including at least one compressible, resilient member in contact with said connector body for attenuating shock and vibration forces.

3. The connector of claim 1 wherein said constant impedance connector first plug includes an inner and outer conductor and said constant impedance connector female receptacle includes a complementary inner and outer conductor, said first plug and said female receptacle having a predetermined shape such that when said first plug is engaged with said female receptacle, along a central axis of the engaged connection, the effective outer diameter of the inner conductor referenced by "d", the effective inner diameter of the outer conductor referenced by "D", and the dielectric constant of the medium therebetween referenced by $\in$, satisfy the equation:

$$Z=138(\in)^{-1/2}\log(D/d)$$

where "Z" is the characteristic impedance, and said characteristic impedance is substantially constant throughout said central axis of said engaged connection.

* * * * *

UNITED STATES PATENT AND TRADEMARK OFFICE

CERTIFICATE OF CORRECTION

PATENT NO. : 7,670,176 B2
APPLICATION NO. : 12/265892
DATED : March 2, 2010
INVENTOR(S) : Donald V. Lemke and Yefim Torban It is certified that error appears in the above-identified patent and that said Letters Patent is hereby corrected as shown below:

Title Page; item (63);

On the Cover Page of the Patent Please Insert:

-- Related U.S. Application Data Continuation of application No.: 11/689,823, filed on March 22, 2007, now Pat. No. 7,448,907, issued November 11, 2008. --

Signed and Sealed this
Twenty-first Day of June, 2011

David J. Kappos

David J. Kappos
*Director of the United States Patent and Trademark Office*